United States Patent [19]

Takahashi

[11] 4,444,864

[45] Apr. 24, 1984

[54] METHOD FOR EFFECTING DEVELOPMENT BY APPLYING AN ELECTRIC FIELD OF BIAS

[75] Inventor: Tohru Takahashi, Tokyo, Japan

[73] Assignee: Canon Kabushiki Kaisha, Tokyo, Japan

[21] Appl. No.: 335,462

[22] Filed: Dec. 29, 1981

Related U.S. Application Data

[63] Continuation of Ser. No. 167,195, Jul. 9, 1980, abandoned.

[30] Foreign Application Priority Data

Jul. 16, 1979 [JP] Japan ..... 54-91168

[51] Int. Cl.[3] ..... G03G 13/08

[52] U.S. Cl. ..... 430/120; 430/122; 118/653; 118/657; 118/658

[58] Field of Search ..... 430/102, 125, 120, 122; 118/647, 651, 654, 658, 653

[56] References Cited

U.S. PATENT DOCUMENTS

| | | | |
|---|---|---|---|
| 2,758,525 | 8/1956 | Mowcrieff-Yeates | 430/97 |
| 2,803,177 | 8/1957 | Lowrie | 118/650 |
| 2,838,997 | 6/1958 | Mowcrieff-Yeates | 430/120 |
| 2,839,400 | 6/1958 | Mowcrieff-Yeates | 430/120 |
| 2,862,816 | 12/1958 | Mowcrieff-Yeates | 430/120 |
| 2,996,400 | 8/1961 | Rudd et al. | 118/638 |
| 3,232,190 | 2/1966 | Willmott | 118/647 |
| 3,666,363 | 5/1972 | Tanaka et al. | 430/125 |
| 3,703,157 | 11/1972 | Maksymiak et al. | 118/654 |
| 3,866,574 | 2/1975 | Hardennrook et al. | 118/651 |
| 3,890,929 | 6/1975 | Walkup | 118/647 |
| 3,893,418 | 7/1975 | Liebman et al. | 118/647 |
| 3,909,258 | 9/1975 | Kotz | 430/101 |
| 3,918,966 | 11/1975 | Metcalfe et al. | 430/91 |
| 4,071,361 | 1/1978 | Marushima | 430/98 |
| 4,102,305 | 7/1978 | Schwarz | 118/658 |
| 4,121,931 | 10/1978 | Nelson | 96/1 SD |
| 4,292,387 | 9/1981 | Kanbe et al. | 430/102 |

*Primary Examiner*—John E. Kittle
*Assistant Examiner*—John L. Goodrow
*Attorney, Agent, or Firm*—Fitzpatrick, Cella, Harper & Scinto

[57] ABSTRACT

The present invention includes a method for effecting development by coating an insulative toner on a developer supporting member having its conductive surface in the form of a roller or the like and then contacting the toner layer with a latent-image bearing surface. Furthermore, a cyclic displacement voltage such as AC voltage and pulsating voltage is applied between the development clearance to produce such an electric field of bias that, in at least the latter half of the developing process, is smaller than a threshold for actually separating the toner in such a direction that the deposited toner is separated from the image area, and also smaller than a so-called fog threshold for actually depositing the toner in such a direction that the toner is deposited on a non-image area.

19 Claims, 21 Drawing Figures

METHOD FOR EFFECTING DEVELOPMENT BY APPLYING AN ELECTRIC FIELD OF BIAS

This is a continuation of application Ser. No. 167,195 filed July 9, 1980, now abandoned.

BACKGROUND OF THE INVENTION

1. Field of the Invention

The present invention relates to a development method in the field of electrophotography or electrostatic recording, particularly of such a type that electrostatic images are developed by the use of a one-component developer. More particularly, the present invention relates to a method for effecting development by coating a one-component toner on the endless surface of a resilient conductive supporting member in the form of a roller or belt which is rotatably or movably mounted, and then transferring the toner to an electrostatic image bearing surface.

2. Description of the Prior Art

Various types of developing method using a one-component developer are heretofore known such as the powder cloud method which uses toner particles in cloud condition, the contact developing method in which a uniform toner layer formed on a toner supporting member comprising a web or a sheet is brought into contact with an electrostatic image bearing surface to effect development, and the magnedry method which uses a conductive magnetic toner formed into a magnetic brush which is brought into contact with the electrostatic image bearing surface to effect development.

Among the above-mentioned developing methods using the one-component developer, the powder cloud method, the contact developing method and the magnedry method are such that the toner contacts both the image area to which the toner should be adhered and the non-image area or background area to which the toner should not be adhered and therefore the toner more or less adheres to the non-image area as well, thus unavoidably creating the so-called fog or background deposition.

To avoid such fog, there has been proposed the transfer development with space between a toner donor member and an image bearing member in which a toner layer and an electrostatic image bearing surface are disposed in opposed relationship with a clearance therebetween in a developing process so that the toner is caused to fly to the image area by the electrostatic field thereof and the toner does not contact the non-image area. Such development is disclosed, for example, in U.S. Pat. Nos. 2,803,177; 2,758,525; 2,838,997; 2,839,400; 2,862,816; 2,996,400; 3,232,190 and 3,703,157. This development is a highly effective method in preventing the fog or background deposition. Nevertheless, the visible image obtained by this method generally suffers from the following disadvantages because it utilizes the flight of the toner across the air gap resulting from the electric field of the electrostatic image during the development.

A first disadvantage is the problem that the sharpness of the image is reduced at the edges of the image. The state of the electric field of the electrostatic image at the edge thereof is such that if an electrically conductive member is used as the developer supporting member, the electric lines of force which emanate from the image area reach the toner supporting member so that the toner particles fly along these electric lines of force and adhere to the surface of the photosensitive medium, thus effecting development in the vicinity of the center of the image area. At the edges of the image area, however, the electric lines of force do not reach the toner supporting member due to the charge induced at the non-image area and therefore the adherence of the flying toner particles is very unreliable and some of such toner particles barely adhere while some of the toner particles do not adhere. Thus, the resultant image is an unclear one lacking sharpness at the edges of the image area, and line images, when developed, give an impression of having become thinner than the original lines.

To avoid this in the above-mentioned toner transfer development, the clearance between the electrostatic image bearing surface and the developer supporting member surface must be sufficiently small (e.g. smaller than 100μ) and actually, accidents such as pressure contact of the developer and mixed foreign substances are liable to occur between the two surfaces. Also, maintaining such a fine clearance often involves difficulties in designing of the apparatus.

A second problem is that images obtained by the above-mentioned toner transfer development usually lack half-tone reproducibility. In the toner transfer development, the toner does not fly until the toner overcomes the binding power of the toner supporting member by the electric field of the electrostatic image. This power which binds the toner to the toner supporting member is the resultant force of the Van der Waals force between the toner and the toner supporting member, the force of adherence among the toner particles, and the reflection force between the toner and the toner supporting member resulting from the toner being charged. Therefore, flight of the toner takes place only when the potential of the electrostatic image has become greater than a predetermined value (hereinafter referred to as the transition threshold value of the toner) and the electric field resulting therefrom has exceeded the aforementioned binding force of the toner, whereby adherence of the toner to the electrostatic image bearing surface takes place. But the binding power of the toner to the supporting member differs in value from particle to particle or by the particle diameter of the toner even if the toner has been manufactured or prepared in accordance with a predetermined prescription. However, it is considered to be distributed narrowly around a substantially constant value and correspondingly the threshold value of the electrostatic image surface potential at which the flight of toner takes place also seems to be distributed narrowly around a certain constant value. Such presence of the threshold value during the flight of the toner from the supporting member causes adherence of the toner to that part of the image area which has a surface potential exceeding such threshold value, but causes little or no toner to adhere to that part of the image area which has a surface potential lower than the threshold value, with a result that there are only provided images which lack the tone gradation having steep $\gamma$ (the gradient of the characteristic curve of the image density with respect to the electrostatic image potential).

In view of such problems, a developing device in which a pulse bias of very high frequency is introduced across an air gap to ensure movement of charged toner particles flying through the air gap, whereby the charged toner particles are made more readily available to the charged image is disclosed in U.S. Pat. Nos. 3,866,574; 3,890,929 and 3,893,418.

Such high frequency pulse bias developing device may be said to be a developing system suitable for the line copying in that a pulse bias of several KHz or higher is applied in the gap between the toner donor member and the image retaining member to improve the vibratory characteristic of the toner and prevent the toner from reaching the non-image area in any pulse bias phase but cause the toner to transit only to the image area, thereby preventing fogging of the non-image area. However, the aforementioned U.S. Pat. No. 3,893,418 states that a very high frequency (18 KHz–22 KHz) is used for the applied pulse voltage in order to make the device suitable for the reproduction of tone gradation of the image.

Moreover, in U.S. patent applications Ser. Nos. 58,434, the continuation of which matured into U.S. Pat. No. 4,395,476, on July 26, 1983 and 58,435, now U.S. Pat. No. 4,292,387, issued Sept. 29, 1981 assigned to the present assignee, it has been proposed that, in order to obtain better half-tone gradations of the image, an AC voltage of low frequency may be applied to a small air gap between the toner supporting member and the latent image bearing member to cause the toner particles to reciprocate in said air gap so that the latent images will be developed. These prior arts provide better one-component development methods.

SUMMARY OF THE INVENTION

It is an object of the present invention to provide a one-component developing method in which a latent image is developed by subjecting an insulative developer to the action of an electric field with a view to improve the tone reproduction of a line copy in the type of contact development.

Another object of the present invention is to provide a developing method of higher gradation which can overcome the disadvantages in the prior art by applying an AC or pulsating bias between a resilient conductive surface and an electrode of a member for supporting an electrostatic image bearing layer.

Other objects and features of the present invention will be apparent from the following description of some embodiments of the invention taken in conjunction with the accompanying drawings.

DESCRIPTION OF THE PREFERRED EMBODIMENTS

Embodiment 1

Figure 1:
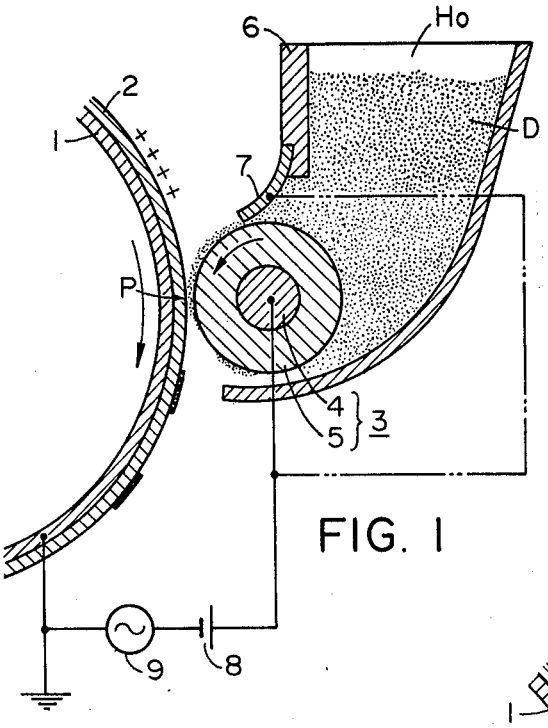
FIG. 1 is a schematic cross-section showing a first embodiment of the present invention explaining the principle thereof.

FIG. 1 shows an embodiment of the present invention, a support electrode 1 includes an electrostatic image bearing layer 2 which is mounted thereon and used to form an electrostatic image under the action of the conventional electrostatic image forming apparatus which is not shown, the electrostatic image formed on the bearing layer 2 being carried to a development station. The support electrode 1 may be in the form of a drum which is made of aluminum or a belt which is deposited by metal. The electrostatic image bearing layer may be in the form of an insulative film for electrostatic recording or a photoconductive insulating layer of such a material as Se, CdS or the like. In the contact developing process of the present invention, it is preferred that the photoconductive layer includes a phototransmissive insulator film laminated thereof since it has better durability. The conventional electrostatic image forming apparatus includes a corona discharging device or image exposing device as known in the art which utilize a pin-like electrode or photoconductive element.

The electrostatic image bearing layer 2 is engaged by a conductive roller 3 of rubber which is used as a development roller. The conductive rubber roller 3 includes a metal shaft 4 and an outer layer 5 which is preferred to have a hardness in the range of between about 25° and about 50°. In order to obtain the satisfactory hardness and surface of the conductive rubber roller 3, it may include a porous rubber layer (sponge) mounted around the shaft 4 and a conductive rubber layer, for example, a conductive silicone tube which covers the outer periphery of the porous rubber layer. The outer layer of the conductive roller 3 may be also formed of synthetic resin or similar materials with a suitable resiliency. Furthermore, this outer layer of the roller 3 is selected in triboelectric series to give a charge polarity opposite from that of the latent image potential to a one-component insulative toner under friction.

Above or sidewise the conductive rubber roller 3 there is located a vessel wall 6 to form a hopper $H_o$ for receiving the insulative toner. A blade 7 is located between the hopper and the conductive rubber roller 3. The blade 7 is slidably engaged by the surface of the roller 3 to coat the toner thereover. The blade 7 may be formed of either conductive or insulative materials such that it will be formed with a suitable thickness and give triboelectric charges to the toner. Such materials include sheet metal, rubber and the like.

The toner in the hopper is drawn out therefrom by the friction with the roller 3 in addition to gravity and rubber strongly by the blade 7 and roller 3 in the vicinity of the exit so that the toner will be applied to the development roller as a coating layer having a frictional charge and a predetermined thickness. The toner can be held on the development roller by a physical adhesion as well as a reflective force of the toner charge against the surface of the conductive rubber roller. The surface of roller is approached to the electrostatic image bearing surface at substantially the same velocity as that of this bearing surface and then engaged by the bearing surface through the toner layer under a small pressure so that a strong electric field will be produced between the electrostatic image and the conductive roller for the toner layer to be drawn strongly from the roller to the electrostatic image. As the surface of roller is being separated from the latent image bearing surface past the nearest point, the toner image is transferred to the electrostatic image area, thus completing the development process.

In accordance with the present invention, an area between the support electrode 1 of the electrostatic image bearing member and the conductive development roller 3, that is, a narrow area including the nearest point P is applied by AC or pulsating voltage in addition to DC bias voltage for preventing any fog, correspondingly forming an electric field. The strength of the electric field, in at least the non-image area (bright area), is controlled to be smaller than a threshold for transference in such a direction that the toner is transferred from the surface of the outer roller layer 5 to the image forming surface 2, thereby avoiding the background deposition. On the other hand, the strength of the electric field is determined to be larger than a threshold for transference in such a direction that the toner transferred to the image forming surface 2 (fog-producing toner) is brought back to the roller surface, thereby removing the fog. In accordance with the present invention, furthermore, the electric field applied in such a manner is limited such that the transference of toner cannot be interfered by the above electric field in an image area (dark area). Namely, in the image area, the electric field has a strength larger than a threshold of transference in such a direction that the toner is transferred from the roller to the image forming surface and smaller than a threshold of transference in the opposite direction that the transferred toner is brought back to the roller. The construction shown in FIG. 1 is connected both with a source of DC bias 8 and a source of AC or pulsating bias 9. If the blade 7 is formed of a conductive material, it is preferably applied by the same voltage as in the roller 3 to eliminate the potential difference therebetween.

Figure 2A:
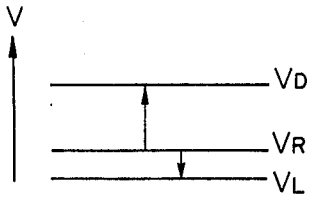
FIG. 2A showing electric potentials at various portions during the development, FIG. 2B showing a graph which is plotted by electric fields in an image area and FIG. 2C showing a graph which is plotted by electric fields in a non-image area.
Figure 2B:
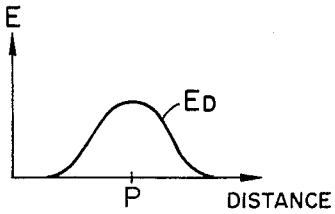
FIGS. 2 (A, B and C) illustrates a DC bias system in the prior art.
Figure 2C:
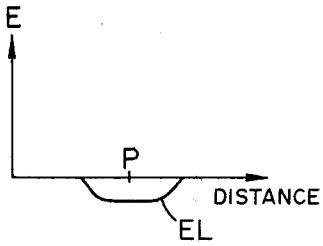

FIG. 2 illustrates the variations of voltage and electric field when DC bias is applied between the roller 3 and the support electrode 1 as in the prior art. FIG. 2A shows a graph plotted by various values of potential in image area ($V_D$), potential in non-image area ($V_L$) and potential in the roller 3 ($V_R$) relative to one another when the voltages in these portions are taken on a longitudinal scale, in the development process. FIG. 2B is a graph showing the variations of an electric field ($E_D$) between the development roller 3 and the image bearing surface 2 in the image area, this graph representing that the electric field becomes larger as the roller 3 is approaching to the image bearing surface while it becomes smaller as the distance between the roller and bearing surface increases. FIG. 2C is a graph showing a similar electric field ($E_L$) in the non-image area, this electric field being directed in such a direction as to prevent the toner from transferring.

Figure 3A:
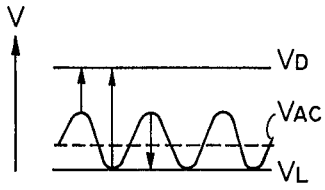
FIGS. 3 (A, B and C) illustrates a development bias in accordance with the present invention, FIG. 3A showing electric potentials at various portions during the development, FIG. 3B showing a graph which is plotted by electric fields in an image area and FIG. 3C showing a graph which is plotted by electric fields in a non-image area.
Figure 3B:
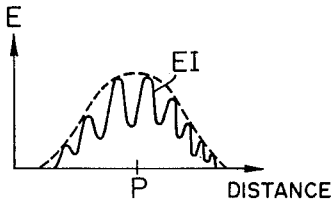
Figure 3C:
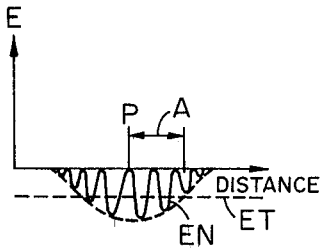

FIG. 3 illustrates the variations of voltage and electic field when AC or pulsating voltage ($V_{AC}$) is applied between the roller 3 and the image bearing surface 2 in accordance with the present invention. FIG. 3A shows different potentials in the various portions between the roller 3 and the image bearing surface 2. As shown in FIG. 3B, the image area includes an electric field ($E_I$) for promoting the development within a narrow extent including the nearest point P. The peak of this electric field ($E_I$) is larger than that of the electric field ($E_D$) in FIG. 2B As shown in FIG. 3C, the non-image area includes an electric field (EN) in the narrow extent including the nearest point P, this electric field having its peak value larger than that of the electric field ($E_L$) shown in FIG. 2C. The peak value of the electric field (EN) is larger than a threshold (ET) as shown by a broken line in FIG. 3C which is required to return the transferred toner from the non-image area to the roller 3. Consequently, the toner will be effectively prevented from depositing on the non-image area to avoid the fog in a region A showing the movement of the image surface which is moving away from the roller 3 after the image surface has been passed through the nearest point P between the roller 3 and the support electrode 1.

Figure 4A:
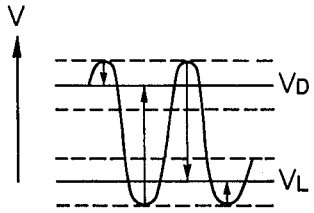
FIGS. 4 (A, B and C) is a view similar to FIGS. 3 (A, B and C) but illustrating another development bias of the present invention which is different from the embodiment shown in FIGS. 3 (A, B and C)
Figure 4B:
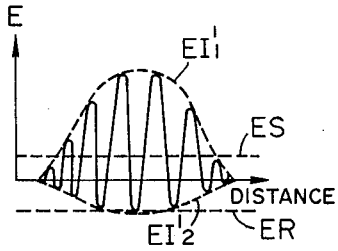

FIG. 4 illustrates the variations of voltage and electric field when AC or pulsating voltage having larger amplitude is applied to the roller 3. FIG 4A is a graph showing a relationship between the values of voltage in the respective portions as in FIG. 3A. Similarly, FIG. 4B is a graph showing the variations of electric field in the image area as in FIG. 3B. It is understood from FIG. 4B that the bias for promoting the development produces a larger electric field ($EI_1'$) as well as the opposite electric gield ($EI_2'$) protruding downwardly from the horizontal axis. The opposite electric field serves to separate the transferred toner from the image surface to return it to the roller 3. If the electric field ($EI_2'$) for separation is smaller than the threshold (ER) for separation, there is no separation of the toner from the image surface. Therefore, only the electric field ($EI_1'$) can be increased.

Figure 4C:
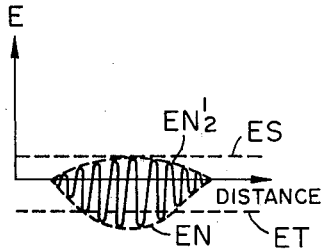

FIG. 4C shows the variations of electric field in the non-image area. This represents that there is a larger electric field ($EN_1'$) for preventing the fog. However, the opposite electric field ($EN_2'$) is also produced to protrude upwardly from the horizontal axis. The opposite electric field ($EI_2'$) is in the direction of the development so that the fog will be promoted. However, if the opposite electric field is smaller than the threshold (ES) which is required to transfer the developer from the roller 3 to the image surface, the fog cannot be substantially promoted.

It is thus to be noted that, by applying a cyclic displacement voltage such as AC or pulsating voltage to the development roller 3, the development is promoted in the image area while the fog is eliminated in the non-image area.

Figure 5A:
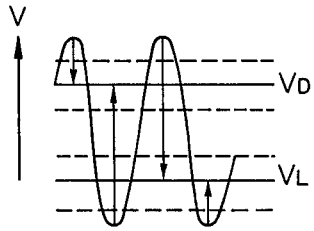
FIGS. 5 (A, B and C) is a view similar to FIGS. 3 (A, B and C) and 4 (A, B and C) but illustrating a still further embodiment of the present invention which is different from the previous embodiments shown in FIGS. 3 (A, B and C) and 4 (A, B and C)
Figure 5B:
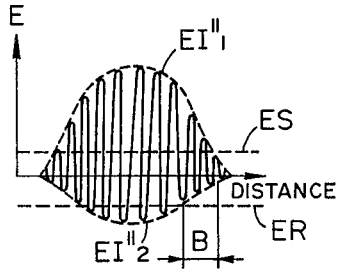
Figure 5C:
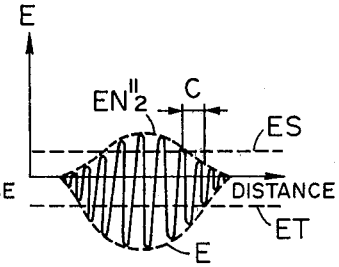

FIG. 5 illustrates the variations of voltage and electric field when the roller 3 is applied by a cyclic displacement voltage having an amplitude larger than that of FIG. 4. In this case, as shown in FIG. 5B, an electric field ($EI_1''$) for promoting the development is further increased whereas an electric field ($EI_2''$) for separating the toner is also increased beyond the threshold (ER) for separation so that the toner will be actually separated from the image surface to return to the roller 3 in the image area. However, as the roller 3 is rotated away from the image surface 2 in the latter half of the development process, the electric field ($EI_2''$) is reduced to be smaller that the threshold (ER) for separation in a region B shown in FIG. 5B. Consequently, the development will be exclusively effected resulting in substantially negligible separation of the toner in the image area. In the non-image area, as shown in FIG. 5C, the electric field ($EN_2''$) for promoting the fog is increased beyond the threshold (ES) to produce the fog. However, this electric field ($EN_2''$) is also decreased in the latter half of the development process to exclusively eliminate the fog in a region C shown in FIG. 5B. In addition, this embodiment improves the reproducibility of tone by closely controlling the development under the reciprocation of the toner.

As seen from the detailed description of the embodiments, the present invention provides an improved development process in which the fog produced by engaging the toner on the development roller with the electrostatic image bearing surface under pressure can be easily eliminated so that a stronger electric field will be sufficiently utilized at very small distance between the development roller and the electrostatic image bearing surface resulting in excellent images with higher concentration and no fog.

In the present invention, either magnetic toner or non-magnetic toner may be utilized effectively. The roller may be a non-magnetic rotating cylinder having a resilient conductive layer and a magnet which is rotatably of fixedly located within said cylinder. The blade for coating may be a magnetic blade which cooperates with said magnet to form a magnetic curtain for coating the magnetic toner.

The roller can be rotated by either the friction with the electrostatic image bearing surface or a separate drive mechanism with substantially no relative velocity between the roller and the electrostatic image bearing surface or with a velocity which is slightly different from that of the electrostatic image bearing surface. The bias is determined depending upon a relationship with respect to the image and non-image areas in the electrostatic image bearing surface as described hereinbefore. The bias is normaly selected to have an amplitude, that is, peak-to-peak value in the range of 1,600 to 500 V and an AC component in the range of $|400-0|$ V which may be plus or minus depending upon the polarity of the latent image because the voltage in the image is normally in the range of 1000–300 V and the voltage in the non-image area is usually in the range of 200––200 V. The AC voltage may be strained instead of the AC voltage superposed by the DC voltage. The frequency is preferably in the range of few cycles in the development process and suitably in the range of 1000–100 Hz depending upon the velocity of development. However, if the frequency is extremely low, for example, below 100 Hz, images tends to be developed with unevenness. It has been experimentally found that the lower limit of the frequency ($f_{min}$) is preferably $0.3\times V_p$ wherein $V_p$ is a development speed which may be called as a process speed. The shape of wave may be of either a sine wave, a serrated wave or a square wave. It is however advantageous in cost that the sine or similar wave is used.

The other embodiments of the present invention will now be described with reference to the accompanying drawings in which similar parts are designated by similar numerals except when they are particularly referred to.

Embodiment 2

Figure 6A:
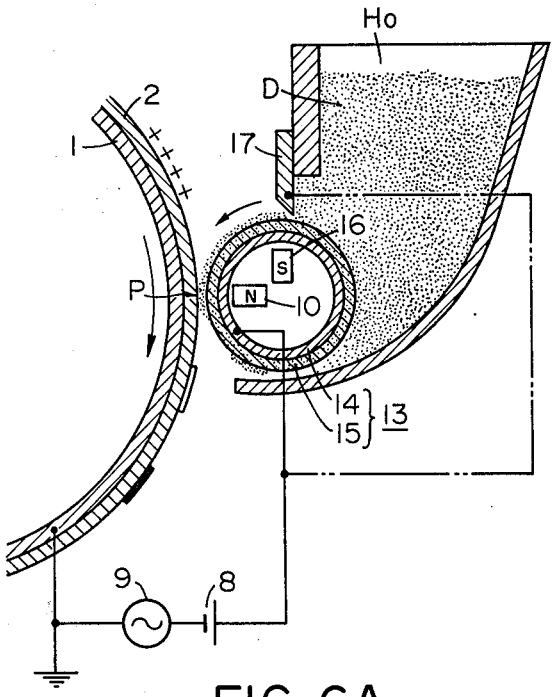
FIG. 6A is a cross-sectional view showing another embodiment of the present invention.
Figure 6B:
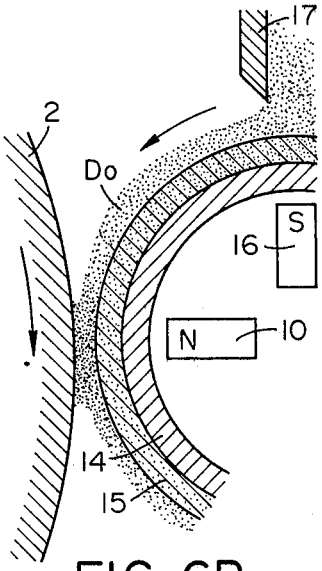
FIG. 6B is a view showing part of the construction in FIG. 6A in an enlarged scale.

FIG. 6 shows a second embodiment of the present invention. A rubber roller 13 which is a movable member is rotated in such a direction as shown by an arrow. Above the rubber roller 13 there is located a hopper $H_o$ which receives a magnetic toner D of any suitable insulative material having a resistivity of $10^8\Omega$.cm or more for the purpose of the invention. The toner D is fed onto the rubber roller 13 through the lower outlet of the hopper $H_o$ to form a toner layer $D_o$ which is deposited on the surface of the rubber roller 13. This toner layer $D_o$ is carried as the rubber roller 13 is rotated. The hopper $H_o$ includes a blade 17 of magnetic material located at the lower outlet thereof which is positioned relative to a magnet 16 disposed within the rubber roller. The magnet 16 produces a magnetic field together with the magnetic blade 17 to control the toner layer $D_o$ on the rubber roller into a small thickness. This cooperation between the magnetic elements 16 and 17 is described, for example, in U.S. patent application Ser. Nos. 983,494, the continuation of which issued as U.S. Pat. No. 4,386,577 on June 7, 1983 and 58,435, now U.S. Pat. No. 4,292,387, issued Sept. 29, 1981. The levelled toner layer on the rubber roller is contacted with an electrostatic image formed in a process as described, for example, in U.S. Pat. Nos. 3,666,363, 4,071,361 or others so that a visible image will be formed.

Preferably, the rubber roller 13 has a resistivity of $10^8\Omega$.cm or less, more preferably $10^4\Omega$.cm. In order to improve the deposition of toner, the rubber roller may have its rough surface formed thereon, for example, by the use of sand paper. If such surface includes a conductive area and a non-conductive area, images having better gradation can be obtained.

As described with reference to the first embodiment, AC electric field is produced between the electrostatic image and the rubber roller 13 in accordance with the present invention such that the electrostatic drawing force for the toner on the electrostatic image becomes larger than the holding force for the toner on the rubber roller 13.

In the second embodiment, a cylinder 14 of aluminum was covered by a sheet of conductive rubber 15 containing carbon black to form a development roller. The gap between the surface of the development roller and the electrostatic image bearing member 2 in the development station was maintained at about 80μ while the gap between the development roller and the blade was held at about 200μ. The toner layer was formed with its thickness of about 80μ under the influence of the magnetic field which is produced between the iron blade 117 and the magnet 16. The average of the magnetic field was 1600 gauss. The development roller was provided with a magnet 10 which is located therewithin relative to the electrostatic image bearing member in the development station. This magnet 10 represents a magnetic field of about 800 gauss in the surface of the development roller and serves to form a magnetic brush of toner.

An insulative magnetic one-component toner having a resistivity in the range of $10^{12}$–$10^{13}\Omega$.cm was prepared as a mixture consisting of 75 parts of polystyrene, 15 parts of magnetite, 3 parts of charge controlling agent and 6 parts of carbon in a well-known manner. The average particle diameter of this toner was 7–15μ. The toner was designed to have its polarity of minus since the electrostatic image had its polarity of plus. The gap between the electrostatic bearing member and the development roller was applied by AC voltage having an alternating shape of wave with an amplitude (peak-to-peak value) of 900 V and a frequency of 200 Hz in addition to DC voltage of 300 V resulting in solid-black images having better gradation with no fog.

Embodiment 3

Figure 7:
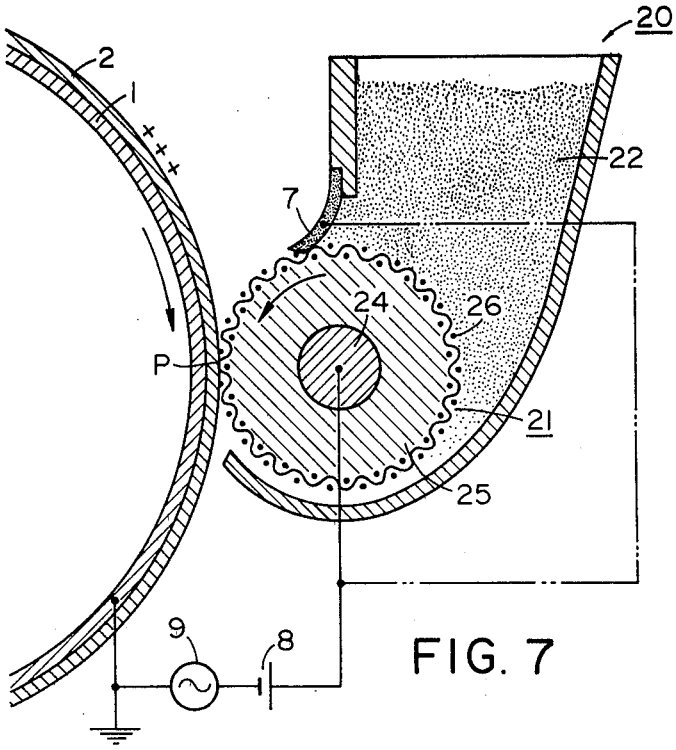
FIGS. 7 to 10 are cross-sectional views showing various embodiments of the present invention respectively.

In FIG. 7, numeral 1 designates a photosensitive member for forming electrostatic latent images as in the previous embodiments.

A developing device 20 includes a resilient conductive development roller 21, a vessel 22 and an applicator blade 7.

The development roller 21 comprises a conductive rigid core layer 24, a resilient intermediate layer of sponge or the like and a non-stretchable flexible toner supporting skin layer 26. The toner supporting skin layer 26 is mounted over the resilient intermediate layer 25 and includes a plurality of very small apertures formed on the surface thereof. The skin layer 26 is frictionally engaged by the blade 7 so that the toner supplied onto the porous surface of the skin layer 26 from the vessel 22 will be suitably packed into the apertures of the skin layer 26 as the toner supporting skin layer is moved relative to the blade 7. Thus, the toner is applied on the development roller 21 and electrically charged at a predetermined charge under the influence of the friction between the blade and the toner supporting skin layer. Subsequently, the development roller 21 is brought into engagement with the electrostatic image bearing member 1 so that the toner will be electrostatically drawn to the image area of the bearing member 1 to deposit thereon. In the non-image area, however, the toner is retained on the toner supporting skin layer 26. Thus, the development will be effected on the electrostatic image bearing member 1.

Various portions of the developing device 20 will now be described. The blade member has a surface of suitable roughness and may be either conductive or insulative. This blade may be slightly contacted with the toner supporting skin layer. Furthermore, the blade may be a rotating member which is rotatably driven in the same direction as the development roller or in the opposite direction thereto. The blade is formed of such a material that is selected to charge the toner with a predetermined polarity departing from frictional charge series between the toner and the blade. The preferred blade is formed, for example, of a plate of Nylon having a hardness of 60°, a thickness of 3 mm and a width of 30 mm which plate is mounted to engage at its tip with the development roller in a substantially tangential direction and to have a fulcrum that is positioned downstream of the roller. A corona charging may be also used with the same function as that of the blade.

Each aperture on the toner supporting skin layer must have a depth of at least one fourth of the average particle diameter of the used toner, preferably in the range of one third to three times thereof. Thus, the present developing device improves a reproducibility of half tone and a concentration of image. If the depth is smaller than one fourth to one third of the above particle diameter, the toner cannot be substantially deposited on the development roller resulting in light images. If the depth is larger than three times of the average particle diameter, the concentration in the images can be sufficiently obtained due to the sufficient movement of the toner, but images having higher value of $\gamma$ can be obtained since the toner is carried away from the apertures in the development process. In accordance with the developing system of the present invention, the blade is engaged by the development roller to improve the deposition of the toner in the image area resulting in excellent images which have higher resolving power. The toner supporting skin layer may include a non-stretchable sheet covering the resilient intermediate layer and a screen formed of fibers each of which has a circular cross-section. The screen may be deformed under pressure. In the preferred embodiment, the screen was a tubular net of 200 meshes having an outer diameter of 38 mm and a rate of opening of 40%, the net being woven by fibers each of which has a diameter of 40μ. The non-stretchable layer 26 serves to prevent the image from being disturbed and may be formed of the conventional cloth.

As shown in FIG. 7, the toner supporting skin layer is not only formed of an etched metal plate but also has apertures each of which is conductive at either bottom or outer edge. Such combination in the toner supporting skin layer can be selected depending upon the characteristics of the developers used. If the toner supporting layer is conductive, the concentration of development is increased. When AC bias is applied to the conductive portion of the resilient intermediate layer 25 or the toner supporting skin layer 26, the fog can be effectively reduced. Moreover, the concentration tends to increase. It is believed that this is because the toner particles move actively.

The photosensitive member cannot be damaged by the resilient roller 21 because it contacts uniformly with the photosensitive member. For example, a pressure between the roller and the drum is in the range of 0.5–3 kg/30 cm. The pressure in this range does not substantially influence the quality of pictures because the resilient intermediate layer effectively absorbs the pressure between the roller and the drum so that the pressure on the toner will be made uniform. The resilient roller was a conductive sponge rubber roller having an outer diameter of 40 mm and a hardness of about 30° as measured by a rubber tester (Asuker Type C). The sponge rubber roller preferably has a conductivity of $10^8\Omega$.cm or less which is determined by the amount of carbon black added to the sponge rubber. The preferred embodiment used the sponge rubber having $10^4$–$10^5\Omega$.cm.

The toner includes powder having an average particle diameter of 7–15μ and a resistivity of $10^{13}\Omega$.cm, which powder consists mainly of 10 parts of carbon and 90 parts of polystyrene.

The gap between the electrostatic image bearing member and the development roller was applied by AC voltage having an amplitude $V_{p-p}$ of 1400 V and a frequency of 300 Hz in addition to DC voltage of 450 V so as to obtain excellent images with improved reproducibility of half tone, sufficient development concentration and no fog. This is because the non-stretchable outermost layer of the roller decreases the disturbance and strain of images, because the toner supporting skin layer 26 revives the pressures between the blade and the development roller and electrostatic image bearing member to reduce the pressure on the toner, and because the resilient intermediate layer 25 functions to make uniform such pressure on the toner so that the agglomeration of toner in the apertures on the roller surface will be properly stabilized to improve the development.

Embodiment 4

Figure 8:
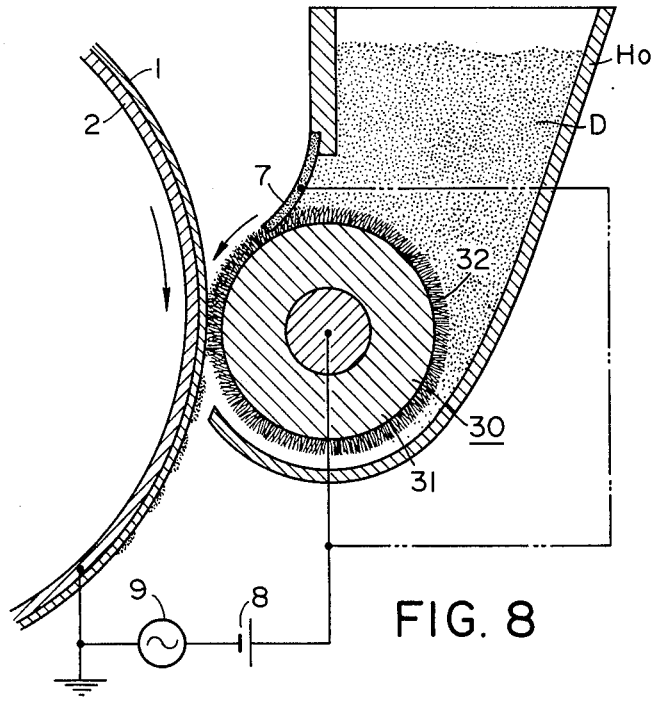

FIG. 8 indicates a resilient conductive development roller by 30, a hopper by Ho, a blade-like frictional charging member by 7, and a photosensitive member by 2, respectively. The developing roller 30 includes a resilient rubber roller 31 and a fur brush 32 covering the roller 31. Onto the development roller 30 there is supplied a developer from the hopper Ho which developer is deposited on the surface of the development roller to move in a direction as shown by an arrow. During this movement, the toner is charged with a predetermined polarity by means by the frictional charging member 7 which engages with the development roller 30 under pressure. Subsequently, the charged toner is contacted with the electrostatic latent image on the photosensitive member 2 to effect a development.

The development roller comprises a conductive rubber roller 31 and a fur brush 32 having flocked threads of nylon and being disposed over the roller 31. The conductive rubber roller 31 has an outer diameter of 40 mm and is formed of a conductive NBR rubber added by carbon black and having a hardness of about 30° as measured by a rubber tester (Asuker Type C). Each thread of the brush includes a conductive portion exposed at part of the surface thereof. The thread may be formed of any material other than nylon and may be whole formed without any conductive exposed portion. If one wants to any conductive portion on the surface of the thread, any conductivity applying agent may sprayed on the nylon thread. In this embodiment, a conductive flocked nylon brush having a length of 3 mm, a diameter of 300 deniers, a density of 30 filaments and a conductivity of $10^4\Omega$.cm was used.

If the fillings of the brush are conductive, an electrode would be positioned close to the toner upon development so that the toner particles on the fillings can be transferred to the photosensitive member at a relatively low electric field having low potential of electrostatic latent image whether the sponge roller 31 is conductive or insulative. As a result, curved lines having sufficient concentration of solid black but wrong gradation will be obtained. On the other hand, if the fillings are insulative, only images having substantially no concentration would be obtained when the sponge roller is insulative since no electrode presents close to the toner upon development. In this case, if the sponge roller is conductive, images having light black color but relatively good gradation would be obtained. In any case, the resultant picture tends to have low concentration and to produce fog if the fillings are insulative.

The toner used was powder of 7–15$\mu$ in average particle diameter which consists of 10 parts of carbon and 90 parts of polystyrene. As aforementioned, the nylon threads and the nylon blade 7 was used to charge such powder with minus. In this embodiment, the gap between the surface of the electrostatic image bearing member and conductive sponge roller was maintained 1–2 mm so that the toner will be contacted with the development roller through the fillings. The gap was applied by AC voltage having an amplitude $V_{p-}$ of 800 V and a frequency of 200 Hz in addition to DC voltage 250 V resulting in excellent images with better gradation, sufficient concentration of solid black and no fog.

Embodiment 5

Figure 9:
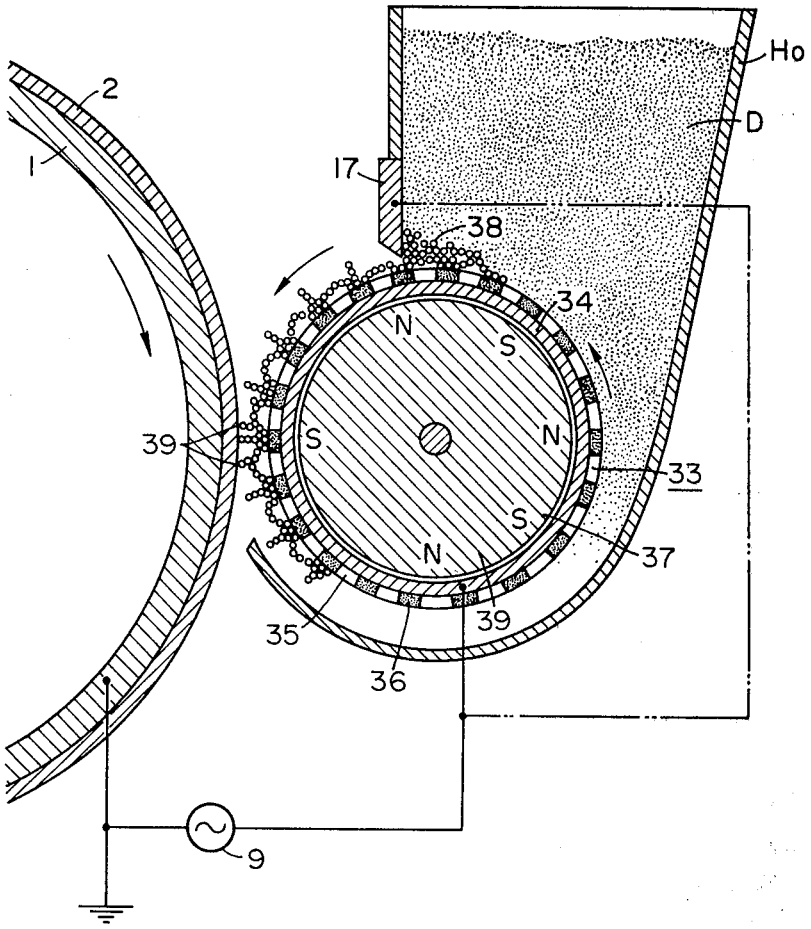

FIG. 9 shows a conductive resilient roller 33 which comprises a non-magnetic sleeve 35 and ferromagnetic bodies mounted firmly on the surface of the sleeve 35, these ferromagnetic bodies being divided into fine area units. The ferromagnetic bodies may be divided into any configuration. For example, the ferromagnetic bodies 36 having a diameter in the range of 0.1–4 mm are disposed on the sleeve 35 at space intervals in the range of 0.1–5 mm or in a zigzag pattern. Alternatively, elongated ferromagnetic bodies 36 having a width of 0.1–4 mm are disposed at space intervals in the range of 0.1–5 mm in the bus-line direction of the sleeve.

The ferromagnetic bodies may be disposed, for example, by applying to the surface of an aluminum cylinder 34 a mixture which is prepared to blend a silicone resin as binder with small ferromagnetic fragments 36. Alternatively, the surface of said aluminum cylinder is applied by a photosensitive resin and photographically etched in a mesh pattern to form a plurality of very small apertures in which the ferromagnetic bodies are embeded. These small apertures may be simply formed also by anodizing the surface of the aluminum cylinder.

The above magnetic development sleeve is rotated by means of a drive mechanism (not shown) in such a direction as shown by an arrow. Therefore, the toner 38 supplied onto the sleeve 33 is levelled by means of the blade 17 into a constant thickness. On the other hand, magnetic induction is produced on the ferromagnetic bodies 36 in the sleeve surface which are opposed to a fixed rod-like magnet so as to form a converged electric field of high density on the surfaces of the ferromagnetic bodies. Namely, each of the ferromagnetic bodies divided into fine area units provides a fine magnet, respectively. The magnetic flux density of the ferromagnetic bodies is partially amplified to a value represented by the following formula:

$$\psi\cdot(S/s)$$

wherein $\psi$ is a magnetic flux produced on the sleeve surface by the internal permanent magnet, S is a surface area of the sleeve and s is a whole area of the ferromagnetic bodies which cover the sleeve surface. Under the influence of the adjacent ferromagnetic bodies 36, the above electric field functions to stand the toner on the sleeve 33 in the vertical direction relative to the sleeve surface to form magnetic brushes 39. This prevents the fog from producing since the height of the magnetic brushes is increased in comparison with that in the prior art cylindrical sleeve in which internal magnets are only disposed. Furthermore, since the electric fields of high density are partly produced in accordance with the distribution of the ferromagnetic bodies 36, the brushes on the sleeve are dense in the electric fields while the brush in the respective fine area unit is rough. Therefore, excellent images will be obtained without any thinned line.

Conductive rubber having a hardness of 75° was applied to the aluminum cylinder, and ferromagnetic pieces 36 each having a size in the range of 0.1–4 mm were embeded on the surface of the non-magnetic sleeve 34 at space intervals in the range of 0.1–5 mm in an alternate manner. A roll-like magnet having N and S poles in the circumferential direction thereof is inserted into the sleeve 34 instead of the magnet to form a magnetic development sleeve. When the fixed magnet 39 of about 800 gauss was disposed within the sleeve, the average density of magnetic flux near the ferromagnetic bodies on the sleeve which are passed near the fixed magnet reached about 1500 gauss or more.

Opposed to the magnet in the sleeve there is disposed a magnetic blade 17 to form a gap between the magnetic development sleeve and the blade 17. When the gap between the image bearing member 2 and the development roll 33 is 300μ, and the gap between the magnetic sleeve and the blade 17 is 200μ, the magnetic one-component toner D supplied from the hopper Ho is applied, with a thickness of 70μ, to the development roll 33 which is rotated in the direction shown by an arrow. The applied toner stands in the position opposed to the image forming member 2 under the influence of the roll magnet 39 in the sleeve 34 to form the magnetic brushes.

As in the previous embodiments, any suitable development bias is applied to the sleeve 6. For example, if a charged latent image having plus polarity is formed on the image forming member and the magnetic toner which can be charged with minus polarity is used, the image forming member 2 is grounded and the sleeve 34 is applied by AC voltage which has a peak voltage $V_{p-p}$ of 1600 V (plus peak=1150 V and minus peak=450 V) and a frequency of 600 Hz and which is strined to minus side resulting in excellent images with no fog, tight lines, better reproducibility of half tone and high concentration of solid black.

Embodiment 6

This embodiment will now be described with reference to FIG. 10.

In the prior art, a developing apparatus is well known of such a type that a magnetic, high resistance, one-component toner on a non-magnetic cylinder (sleeve) is charged and moved toward a development station. In such a developing apparatus, toner charging means includes a frictional charging member in the form of blade or roller which is engaged directly with the surface of the sleeve to charge the toner under friction. Alternatively, a corona charging device may be used to charge the toner without any contact.

A developing apparatus in this embodiment comprises a corona charger by which a one-component toner is convergingly charged with a particular polarity in addition to the application of the bias as described previously. The charged toner is moved to an electrostatic latent image surface by belt type transporting means to develop the latent image. The above corona charger includes grids and grid-bias controlling means.

The advantages of the corona charging are that the toner charge can be prevented from changing under friction, for example, in connection with a rubber blade, and that the toner can be uniformly charged even in high speed.

If the corona charger is grid-bias controlled, the safety can be improved as the charge of the toner is simply changed to the opposite polarity by changing the polarity of the bias voltage which is applied to the grids.

When the toner is controllably charged at the grids to which AC bias is applied, a condenser is connected in series between a source of high voltage and the electrode of the corona charger to shut off the DC component in the charging current which tends to be unstable under the variation of circumstances. Consequently, the toner potential can be converged to a value substantially equal to the grid potential.

It is normally undesirable that the developing apparatus is provided with any charging device since it results in larger size and complicated construction. In view of this situation, this embodiment includes a belt-like toner transporting means such that the supply, application and charging of the toner can be effected at a place apart from the development station to reduce a space which is occupied by the development apparatus near the electrostatic image bearing member.

Figure 10:
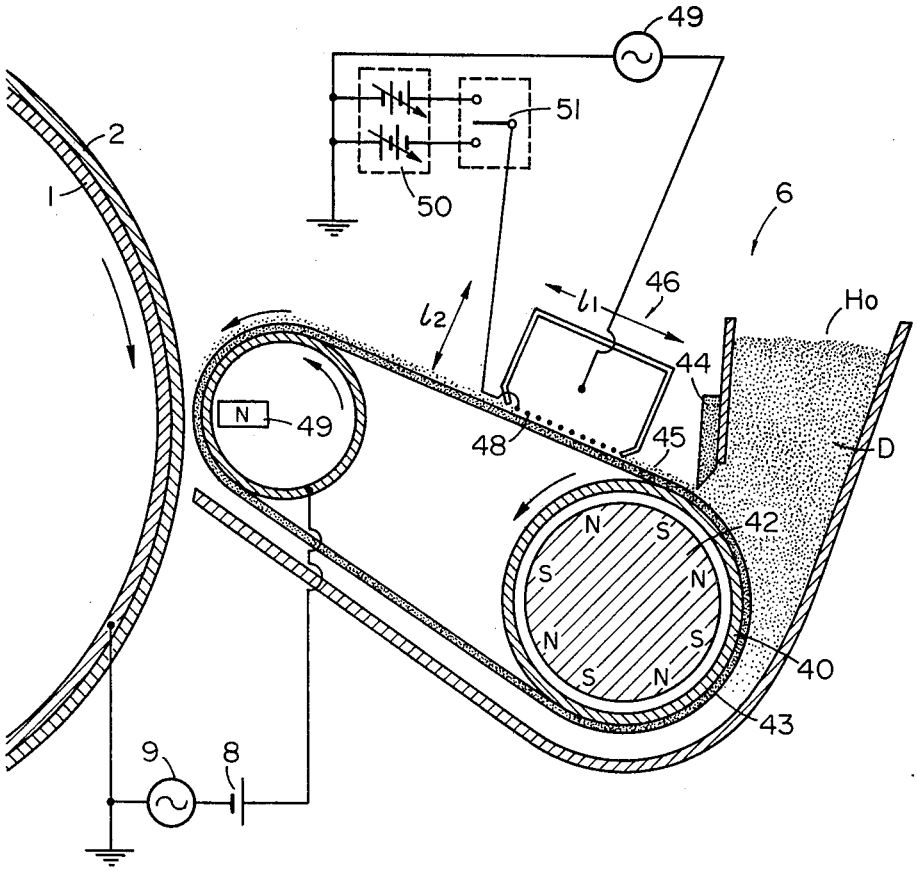

In a developing apparatus shown in FIG. 10, a sleeve 40 includes a magnet 42 located therewithin and is rotated in a direction shown by an arrow. The magnetic toner D is supplied from the hopper Ho to a conductive rubber belt 43 which is moved by the rotation of the sleeve 40. The supplied toner is levelled by a doctor blade 44 at the hopper outlet to form a toner layer 45 having a predetermined thickness. As seen from FIG. 10, the magnet 42 includes S and N poles which are alternately positioned, one of the S poles being located at a position opposed to the magnetic doctor blade 44. The toner retained on the belt 43 is charged with a predetermined polarity by means of the corona charger 46. The charged toner particles are stood on the belt 43 by the influence of a magnetic pole 49 located opposed to a photosensitive member 2 so that the development will be effected. At the same time, a cyclic displacement bias of development is applied to a gap (200μ) between the photosensitive member 2 and the belt 43 as in the first embodiment, such a cyclic bias being AC voltage having a peak voltage $V_{p-p}$ of 1200 V (plus component=850 V) and a frequency of 400 Hz.

Although the magnet 42 is shown to have eight poles in FIG. 10, three or four poles may be adopted in the present invention. Although the illustrated embodiment includes the fixed magnet and the rotating sleeve, the reverse arrangement, that is, a rotating magnet and a fixed sleeve can be also used in the present invention. In the latter case, the magnet is rotated in the opposite direction to the rotation of sleeve as in the former case, and a nonmagnetic doctor blade is preferably used for levelling the toner on the belt. The remaining structure and arrangement are not limited to those in the illustrated embodiment.

FIG. 10 also shows a corona charging device 46 for charging the toner which has, for example, a width $l_1$ of 35 mm and a depth $l_2$ of 28 mm. In this corona charging device, the distance $d_1$ between the grids and the belt is 1.5 mm and the distance $d_2$ from one of the grids to the other is 2 mm. The corona charging electrode consists of a wire of tungsten which is plated by gold and has a diameter of 60μ. Each of the grids 48 consists of a gold-plated wire having a diameter of 100μ. Twelve of such grids 48 are disposed at regular intervals, 2 mm, in an arcuate plane maintained at 1.5 mm away from the surface of the belt. The corona charging device further includes a source of alternate current 49 for corona charging, another source of grid bias 50 and a switch 51 for converting the source of grid bias from plus to minus and vice versa to change the polarity of the charged toner.

The magnetic toner is of an average particle diameter of about 10μ and has its composition consisting of 70% of polystyrene, 20% of magnetite, 8% of carbon and others. Such toner was used to form a toner layer having a thickness of about 50μ. It has been found that, if the latent image potential in a dark area is set at +500 V and the latent image potential in a bright area at −100 V in a well-known manner, the magnetic toner layer can be charged with a charge of about $5\times10^{-16}$ C per each toner particle under such a condition that AC voltage for corona charging is 8 KV (effective value), whole current for charging is 950 μA and grid bias is DC −100 V, resulting in excellent images.

If one wants to convert the polarity of the charged toner into plus, the toner can be charged with plus charge by operating said switch 51 for changing the grid bias. Under the above latent image potentials, excellent negative images can be obtained. Although it is preferred in durability that the diameter of each grid is 100μ, it has been found from experiments that grids having a diameter of 60μ also perform substantially the same function.

This embodiment may include a conductive rubber belt for transporting the toner particles which has magnets located on the back face of the belt opposite to the toner holding face thereof to ensure the holding and transporting of the toner.

Other coating processes for forming the insulative one-component toner layer with a uniform thickness on the surface of the conductive, resilient supporting member will now be simply described which can be used in the aforementioned and other embodiments of the present invention. Of course, the present invention is not limited to these coating processes.

Means for carrying out the coating processes includes, in addition to the aforementioned blade, a magnetic brush contact type, a rotating roller type, a localized vibration coating type and the others. Two examples among them are shown in FIGS. 11 and 12.

Figure 11:
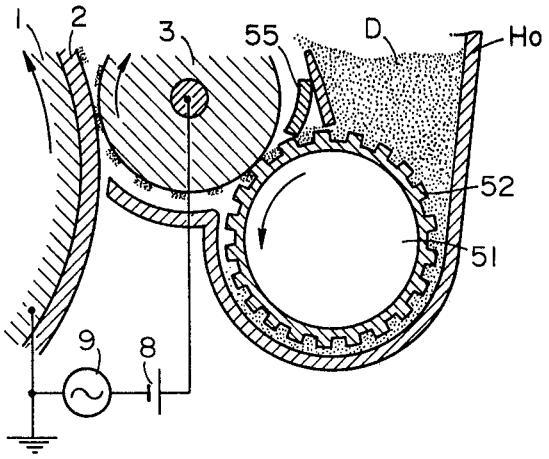
FIGS. 11 and 12 are cross-sectional views exemplifying toner coating means which are applicable to the present invention.

Referring to FIG. 11, a development apparatus is divided into a toner coating station and a development station and suitable for obtaining images with sufficient concentration. The developing apparatus comprises a feed roller 51 having a toner supporting layer 52 and a toner supplying hopper Ho located above the feed roller 51 from which a one-component toner D is supplied onto the toner supporting layer 52 of the feed roller 51 as it is rotated. A friction charging member 55 for charging the toner with a predetermined value is disposed in a path from the hopper Ho to the development station. Subsequently, the toner layer on the feed roller 51 is transferred to the development roller 3 (see FIG. 1) which is disposed in contact with or near the feed roller 51 so that the toner will cause any latent image on the photosensitive member 2 to develop in the development station.

Figure 12:
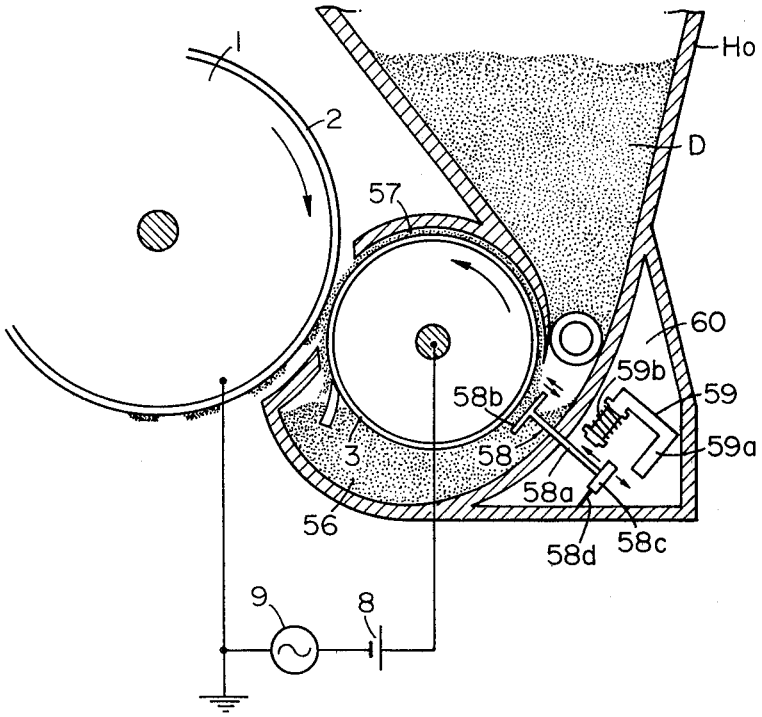

FIG. 12 shows a coating means for applying the toner on the development roller under vibration and designates parts similar to those of FIG. 1 by similar reference numerals. In FIG. 12, a developing apparatus comparises a hopper Ho for containing a non-magnetic one-component toner D and an application chamber 56 formed in the bottom of the hopper for receiving the toner little by little therefrom. The application chamber 56 includes an upper arcuate wall for covering the upper half of the conductive supporting member 3 which is disposed within the application chamber 56 to form a gap 57 together with the upper arcuate wall for preventing the toner layer Da from disturbing.

The development apparatus also includes a vibrating member 58 which consists of a reciprocating rod **58*a* extending through the wall of the application chamber 56 and a plate 58*b* mounted on the extremity of the reciprocating rod 58*a* and positioned opposed to the supporting member 3. Thus, the vibrating member 58 exerts vibration upon only the toner to be just now picked up by the supporting member 3**.

In order to promote the friction charging of the toner, it is extremely effective that the surface of the plate **58*b* facing the supporting member 3 is formed of such a material as to frictionally charge the toner with a predetermined polarity, if the toner used is insulative. The vibrating member 58 is driven by vibratory drive means 59 which is disposed within a chamber 60 formed behind the application chamber 56. When the coil 59*b* on an electromagnet 59*a* is energized by AC voltage, the vibratory drive means 59 actuates the vibrating member 58 through a parmanent magnet 58*c* mounted on the opposite end of the reciprocating rod 58*a*. Between the wall of the chamber 60 and the permanent magnet 58*c* there is provided a resilient shock-absorbing member 58*d*** such as a leaf spring.

The above vibratory drive means can be also accomplished by mechanical means such as cam or supersonic producing means. The amplitude and frequency of vibration can be suitably determined to attain the desired thickness of the toner layer depending upon the properties of the toner and the shapes of the sleeve surface.

Although the surface potentials of the image areas have been described to have plus potential, the present invention can be of course applied also to minus surface potential in the image area. In any case, the insulative toner is applied to the conductive developer supporting member to form a toner layer having a uniform thickness, the toner layer being contacted with the latent image in the development position. Furthermore, the cyclic displacement voltage is applied to the development gap between the developer supporting member and the surface of latent image to produce such an electric field which, in at least the latter half of the development process, is smaller than the threshold for separation in such a direction as to separate the deposited toner again from the image area on the latent image surface (therefore, the deposited toner being not actually separated) and also smaller than the threshold for depositing (fog threshold) in such a direction as to deposit the toner onto the non-image area (therefore, the fog being not actually produced).

In the first half and greater part of the development process, the toner is charged by the cyclic displacement voltage of bias such that the electric field acting on the development gap (of course, varying in progress of the development) for promoting the development in the image area, that is, the electric field for separating the toner from the supporting member and then moving it toward the image area of the latent image surface is larger than the threshold required actually to transfer the toner. At the same time, there may be the electric field for returning the deposited toner from the image area to the supporting member (see FIG. 5B). In the non-image area, the electric field for moving the toner from the non-image area to the toner supporting member, that is, the electric field for avoiding the fog is larger than the threshold (ET) required actually to separate the toner from the non-image area and then return it to the toner supporting member. In this case, there may be the other electric field to produce some fog in the non-image area for promoting the transference of toner toward the image area (see FIG. 5C). Even if the fog is produced, it can be eliminated in the latter half of the development process.

It is to be understood that the present invention is not limited to the aforementioned embodiments but includes all embodiments which can be obtained in accordance with the present invention.

What I claim is:

1. A process of developing a latent image by the use of particulate developer comprising the steps of:

coating an insulative toner on a developer supporting member to form a toner layer;

moving said supporting member with the insulative toner layer placed thereon to bring the insulative toner layer into and then out of contact with both the image and non-image areas of a latent image bearing member; and applying a cyclical voltage to produce an electric field of cyclic displacement between the developer supporting member and the latent image bearing member which electrical field gradually reduces in strength toward the end of toner contact, said applied voltage satisfying the following relations:

$$V_{Max} > V_D$$

$$V_{Min} < V_L$$

where $V_{Max}$ is the maximum value of the applied electric voltage, $V_{Min}$ is the minimum value of the applied electric voltage, $V_D$ is the maximum image area potential and $V_L$ is the minimum non-image area potential;

wherein said electric field is such that at least toward the end of toner contact, at an image area, the electric field in a direction so as to remove the toner which has once attached to the image bearing member, is smaller than the threshold required to actually remove such developer from the image bearing member and, at a non-image area, the electric field in a direction of attaching the developer to the image bearing member to produce fog, is smaller than a threshold required to actually produce fog.

2. The process as defined in claim 1 wherein said cyclic electric field is produced by a voltage having an amplitude (peak-to-peak voltage) in the range of 1600–500 V and a frequency in the range of 1000–100 Hz.

3. The process as defined in claim 1 wherein said cyclic electric field is produced by AC voltage having an amplitude (peak-to-peak voltage) in the range of 1600–500 V and a frequency in the range of 1000–100 Hz, and DC voltage in the range of |400–0| which is superposed on said AC voltage.

4. The process as defined in claim 1 wherein said cyclic electric field is produced by AC voltage having a frequency in the range of 1000–100 Hz, said field being varied according to the polarity of a latent image.

5. The process as defined in claim 1 wherein said cyclic electric field is produced by a pulsating voltage having a frequency in the range of 1000–100 Hz and a polarity determined according to the polarity of the latent image.

6. A process of developing a latent image by the use of particulate developer comprising the steps of:

coating an insulative toner on a developer supporting member to form a toner layer;

moving said supporting member with the insulative toner layer thereon to bring the insulative toner layer into and then out of contact with both the image and non-image areas of a latent image bearing member; and applying a cyclic voltage to produce an electric field of cyclic displacement between the developer supporting member and the latent image bearing member which electrical field gradually reduces in strength toward the end of toner contact, said applied voltage satisfying the following relations:

$$V_{Max} > V_D$$

$$V_{Min} < V_L$$

where $V_{Max}$ is the maximum value of the applied electric voltage, $V_{Min}$ is the minimum value of the applied electric voltage, $V_D$ is the maximum image area potential and $V_L$ is the minimum non-image area potential;

wherein said electric field is such that at least toward the end of toner contact, at an image area, the electric field in the direction of promoting the development is larger than a threshold required to remove the toner from the supporting member, and, at a non-image area, the electric field in the direction of preventing fog is larger than a threshold required to remove the toner from the non-image area.

7. The process as defined in claim 6 wherein said cyclic electric field is produced by a voltage having an amplitude (peak-to-peak voltage) in the range of 1600–500 V and a frequency in the range of 1000–100 Hz.

8. The process as defined in claim 6 wherein said cyclic electric field is produced by AC voltage having an amplitude (peak-to-peak voltage) in the range of 1600–500 V and a frequency in the range of 1000–100 Hz, and DC voltage in the range of 400–0 V which is superposed on said AC voltage.

9. The process as defined in claim 6 wherein said cyclic electric field is produced by AC voltage in the range of 1000–100 Hz, which is strained according to the polarity of a latent image.

10. The process as defined in claim 6 wherein said electric field of cyclic displacement is produced by a pulsating voltage having a frequency in the range of 1000–100 Hz and a polarity determined according to the polarity of the latent image.

11. A process according to claim 1 or 6, wherein, in the middle stage of development, between the initial contact and separation of the toner layer, the electric field has such phases that, at the image area, the electric field in a phase of promoting the development is larger than a threshold required to remove the toner from the developer supporting member, and the electric field in a phase of removing the developer which has once attached to the image bearing member, is smaller than the threshold required to actually remove such developer from the image bearing member, and, at the non-image area, the electric field in a phase of preventing fog is larger than a threshold required to remove the toner from the image bearing member, and the electric field in the phase of attaching the developer to the image bearing member to produce fog, is small than the threshold required to actually produce fog.

12. A process according to claim 1 or 6, wherein, in the middle stage of development, between the initial contact and separation of the toner layer the electric field has such phases that, at the image area, the electric field in a phase of promoting the development is larger than a threshold required to remove the toner from the developer supporting member, and the electric field in a phase of removing the developer which has once attached to the image bearing member, is larger than the threshold required to actually remove such developer from the image bearing member, and, at the non-image area, the electric field in a phase of preventing fog is larger than a threshold required to remove the toner from the image bearing member, and the electric field in the phase of attaching the developer to the image bearing member to produce fog, is larger than the threshold required to actually produce fog.

13. The process as defined in claim 1 or 6 wherein said insulative toner is frictionally charged.

14. The process as defined in claim 1 or 6 wherein said insulative toner is corona-charged.

15. The process as defined in claim 1 or 6 wherein said toner is coated on said supporting member by means of a blade-shaped coating member.

16. The process as defined in claim 1 or 6 wherein said supporting member is a non-magnetic body including a magnet disposed therewithin, and said insulative toner is a magnetic toner.

17. The process as defined in claim 1 or 6 wherein said supporting member includes a resilient body located over the surface thereof.

18. The process as defined in claim 1 or 6 wherein said toner is coated on said supporting member by means of a conductive member to which the same voltage as in said supporting member is applied.

19. A developing device for developing a latent image, carried on a latent image bearing member, with an insulative particulate developer, comprising:

a developer supporting means, spaced from the latent image bearing member, for supporting the developer;

means for supplying the developer to said developer supporting means;

means for conveying the developer to a developing station where the insulative developer is brought into contact with the image and non-image areas of the latent image bearing member and then separated therefrom; and means for applying a cyclic voltage to produce an electric field of cyclic displacement between the image bearing member and said developer supporting means which electric field gradually reduces in strength toward the end of developer contact, said applied voltage satisfying the following relations:

$$V_{Max} > V_D$$

$$V_{Min} < V_L$$

where $V_{Max}$ is the maximum value of the applied electric voltage, $V_{Min}$ is the minimum value of the applied electric voltage, $V_D$ is the maximum image area potential and $V_L$ is the minimum non-image area potential;

wherein said electric field is such that, at least toward the end of developer contact, at an image area, the electric field in a direction of removing the developer which has once attached to said image bearing member, is smaller than a threshold required to actually remove such developer from said image bearing member; and at a non-image area, the electric field in a direction of attaching the developer to the image bearing member to produce fog, is smaller than a threshold required to actually produce the fog.

* * * * *

UNITED STATES PATENT AND TRADEMARK OFFICE

CERTIFICATE OF CORRECTION

PATENT NO. : 4,444,864

DATED : April 24, 1984

INVENTOR(S) : TOHRU TAKAHASHI

It is certified that error appears in the above-identified patent and that said Letters Patent is hereby corrected as shown below:

Column 1, line 22, "method" should read --methods--.

Column 6, line 40, "gield" should read --field--.

Column 7, line 8, "that" should read --than--;
line 35, "of" should read --or--;
line 48, "normaly" should read --normally--;
line 52, after "image" insert --area--;
line 61, "tends" should read --tend--.

Column 9, line 4, delete "of";
line 5, delete "of".

Column 11, line 33, delete "to"; "any" should read --a--;
line 35, before "sprayed" insert --be--;
line 65, "$V_{p-}$" should read --$V_{p-p}$--.

Column 12, line 23, "embeded" should read --embedded--;
line 63, "embeded" should read --embedded--.

Column 13, line 26, "strined" should read --varied--.

Column 15, lines 54-55, "comparises" should read --comprises--.

Column 16, line 14, "parmanent" should read --permanent--.

UNITED STATES PATENT AND TRADEMARK OFFICE

CERTIFICATE OF CORRECTION

PATENT NO. : 4,444,864

DATED : April 24, 1984

INVENTOR(S) : TOHRU TAKAHASHI

It is certified that error appears in the above-identified patent and that said Letters Patent is hereby corrected as shown below:

Column 18, line 36, Claim 8, "400-0 V" should read -- |400-0| V--;

line 40, Claim 9, "which is strained" should read --and said field is varied--;

line 43, Claim 10, before "electric" insert --cyclic-- and delete the phrase "of cyclic displacement".

Signed and Sealed this

Thirtieth Day of October 1984

[SEAL]

Attest:

GERALD J. MOSSINGHOFF

Attesting Officer

Commissioner of Patents and Trademarks